US009297608B1

(12) United States Patent
Ma et al.

(10) Patent No.: US 9,297,608 B1
(45) Date of Patent: Mar. 29, 2016

(54) TOY GUN

(71) Applicant: Alex Brands Buzz Bee Holdings, LLC, Mt. Laurel, NJ (US)

(72) Inventors: Chor Ming Ma, Hong Kong (CN); Brownie Johnson, Mt. Laurel, NJ (US)

(73) Assignee: ALEX BRANDS BEE HOLDINGS, LLC, Mt. Laurel, NJ (US)

( * ) Notice: Subject to any disclaimer, the term of this patent is extended or adjusted under 35 U.S.C. 154(b) by 0 days.

(21) Appl. No.: 14/520,364

(22) Filed: Oct. 22, 2014

(30) Foreign Application Priority Data

Sep. 30, 2014 (HK) ..... 14109844.3

(51) Int. Cl.
*F41B 11/642* (2013.01)
*F41B 11/89* (2013.01)

(52) U.S. Cl.
CPC ..... *F41B 11/642* (2013.01); *F41B 11/89* (2013.01)

(58) Field of Classification Search
USPC ..... 124/65, 66, 69; 42/54
See application file for complete search history.

(56) References Cited

U.S. PATENT DOCUMENTS 5,535,729 A * 7/1996 Griffin et al. ..... 124/66

* cited by examiner

*Primary Examiner* — Reginald Tillman, Jr.
(74) *Attorney, Agent, or Firm* — Nevin Stuart Carmichael

(57) ABSTRACT

A toy gun comprising: a housing; a plurality of projectile chambers each adapted to house a projectile, each projectile chamber being in fixed relationship with the housing; and a pumping apparatus having a delivery interface alignable with each projectile chamber in a sequence, such that when the delivery interface is aligned with one of the projectile chambers, the pumping apparatus is operable to drive air into said one of the projectile chambers via the delivery interface.

8 Claims, 4 Drawing Sheets

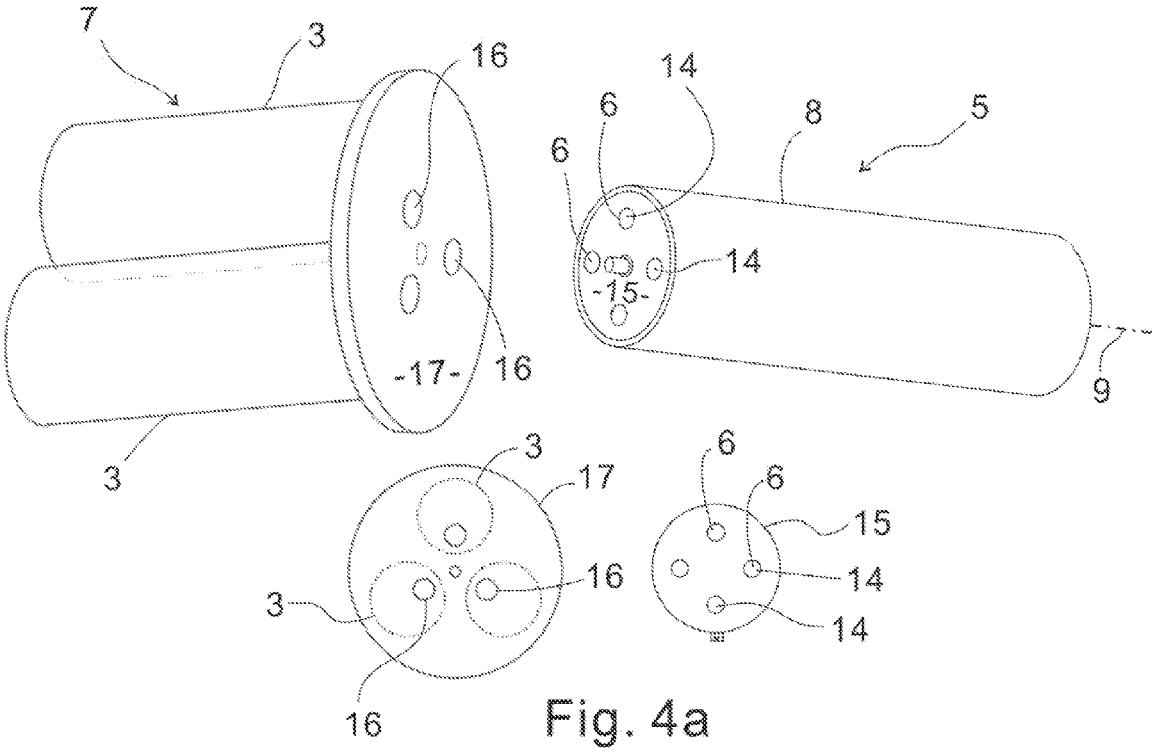
Fig. 4a
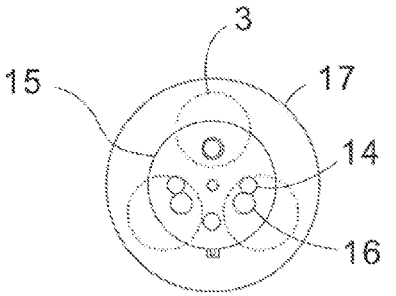
0 degree Fig. 4b
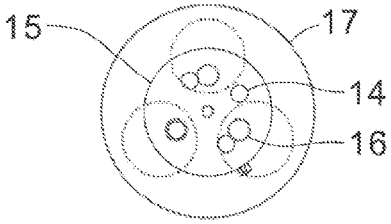
30 degree Fig. 4c
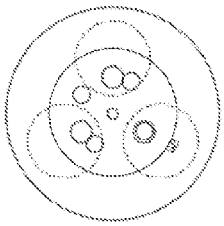
60 degree Fig. 4d

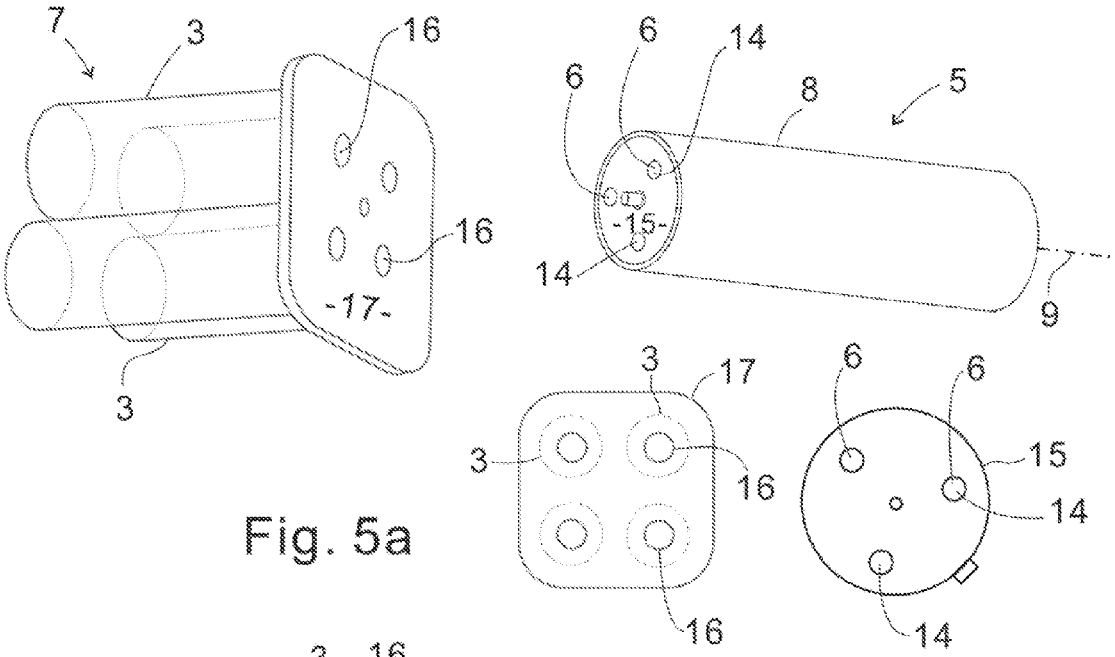
Fig. 5a
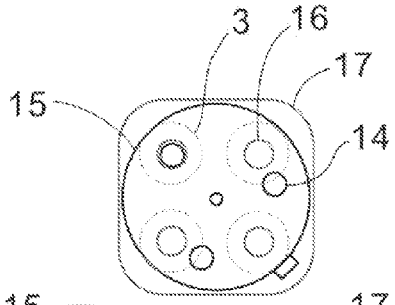
0 degree Fig. 5b
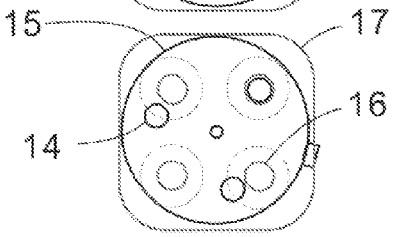
30 degree Fig. 5c
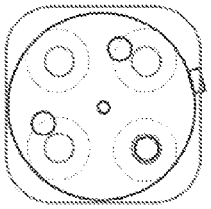
60 degree Fig. 5d
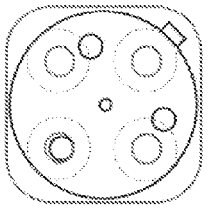
90 degree Fig. 5e 0 degree 36 degree

TOY GUN

FIELD OF THE INVENTION

The present invention relates to toy guns, and in particular, toy guns for launching a plurality of projectiles sequentially.

BACKGROUND OF THE INVENTION

Prior toy guns which are capable of launching a plurality of projectiles sequentially typically have a barrel with a plurality of projectile chambers which are each loaded with one projectile. The projectiles, such as toy darts, are launched by pumping air from a pump chamber into one of the projectile chambers, the movement of the air thereby forcing the projectile from the projectile chamber.

After the first projectile is launched, the barrel is rotated to align the pump chamber with a next projectile chamber so that the next projectile can be launched by pumping air from the pump chamber into the next projectile chamber. Thus, by repeating this process, a plurality of projectiles can be launched sequentially from the toy gun.

Air is typically pumped by way of a spring-loaded pump rod. The toy gun is cocked by drawing the pump rod back against the spring and locking the pump rod in a rearward position against the spring bias. A trigger mechanism is then pulled to release the lock which then allows the pump rod to be thrust forward by the spring bias thereby pumping air into the projectile chamber aligned with the pump chamber.

The barrel can be manually rotated or automatically rotated. In some prior toy guns, automatic rotation is achieved by a trigger mechanism whereby pulling of the trigger turns the barrel by a fixed angle before releasing the pump rod lock so that the next projectile chamber is aligned with the pump chamber.

Automatic rotation is advantageous over manual rotation since it does not require the extra step of manually rotating the barrel. However, the mechanisms required for automatic rotation of the barrel add complexity and bulk to the toy gun. Increased complexity and moving components increases the risk of breakdown which adversely affects the durability of the toy gun. Having a rotating barrel also introduces rotating joints and interfaces that are vulnerable to damage which again adversely affects the durability of the toy gun.

It is an object of the present invention to overcome or ameliorate at least one of the disadvantages of the prior art, or to provide a useful alternative.

SUMMARY OF THE INVENTION

The present invention provides a toy gun comprising:

a housing;

a plurality of projectile chambers each adapted to house a projectile, each projectile chamber being in fixed relationship with the housing; and a pumping apparatus having a delivery interface alignable with each projectile chamber in a sequence, such that when the delivery interface is aligned with one of the projectile chambers, the pumping apparatus is operable to drive air into said one of the projectile chambers via the delivery interface.

In one embodiment, the pumping apparatus comprises a pump tube having a pump axis and a pump ram mounted to slide along the pump axis to drive air along the pump axis into said one of the projectile chambers via the delivery interface.

In one embodiment, the delivery interface is a hole in an endplate at an end of the pump tube, the hole being alignable with each projectile chamber in a sequence upon rotation of the endplate. In another embodiment, the delivery interface is a plurality of holes in an endplate at an end of the pump tube, one of the holes being alignable with one of the projectile chambers upon rotation of the endplate, each projectile chamber being aligned with one of the holes in a sequence. In one embodiment, the number of holes is different to the number of projectile chambers.

In one embodiment, the toy gun further comprises a locking mechanism and a trigger, the locking mechanism operable to lock the pump ram in a cocked position against a resilient bias, the trigger operable to unlock the locking mechanism to release the pump ram from the cocked position, thereby allowing the resilient bias to slide the pump ram along the pump axis to drive air along the pump axis into said one of the projectile chambers via the delivery interface.

In one embodiment, the locking mechanism rotates the endplate as the locking mechanism is operated.

In another embodiment, the trigger rotates the endplate as the trigger is operated. In one embodiment, the trigger rotates the endplate before the trigger unlocks the locking mechanism. In another embodiment, the trigger rotates the endplate after the trigger unlocks the locking mechanism.

Further features of various embodiments of the present invention are defined in the appended claims. It will be appreciated that the features above may be combined in various combinations in various embodiments of the present invention.

Throughout this specification, including the claims, the words "comprise", "comprising", and other like terms are to be construed in an inclusive sense, that is, in the sense of "including, but not limited to", and not in an exclusive or exhaustive sense, unless explicitly stated otherwise or the context clearly requires otherwise.

BRIEF DESCRIPTION OF THE FIGURES

Preferred embodiments in accordance with the best mode of the present invention will now be described, by way of example only, with reference to the accompanying figures, in which:

FIG. 4*a* is a schematic diagram of a barrel and a pump chamber of a toy gun in accordance with another embodiment of the present invention, the barrel having three projectile chambers;

FIG. 4*b* is a front view of the toy gun of FIG. 4*a* showing the pump chamber at 0°;

FIG. 4*c* is a front view of the toy gun of FIG. 4*a* showing the pump chamber advanced by 30°;

FIG. 4*d* is a front view of the toy gun of FIG. 4*a* showing the pump chamber advanced by 60°;

FIG. 5*a* is a schematic diagram of a barrel and a pump chamber of a toy gun in accordance with another embodiment of the present invention, the barrel having four projectile chambers;

FIG. 5*b* is a front view of the toy gun of FIG. 5*a* showing the pump chamber at 0°;

FIG. 5*c* is a front view of the toy gun of FIG. 5*a* showing the pump chamber advanced by 30°;

FIG. 5*d* is a front view of the toy gun of FIG. 5*a* showing the pump chamber advanced by 60°;

FIG. 5*e* is a front view of the toy gun of FIG. 5*a* showing the pump chamber advanced by 90°;

DETAILED DESCRIPTION OF THE BEST MODE OF THE INVENTION

Figure 1:
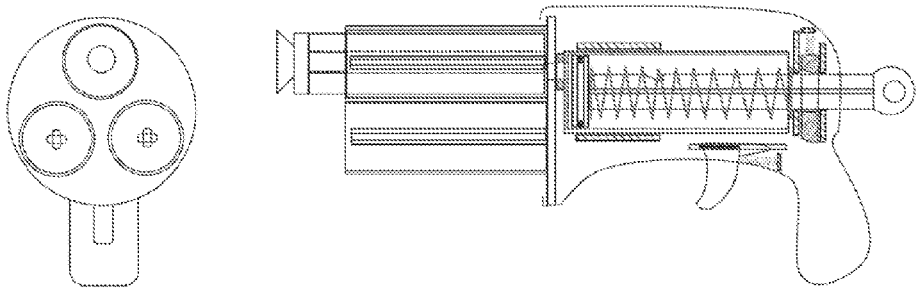
FIG. 1 is a schematic diagram of a prior toy gun having a pump chamber and a barrel with a plurality of projectile chambers, the barrel being manually rotated to align one of the projectile chambers with the pump chamber.
Figure 2:
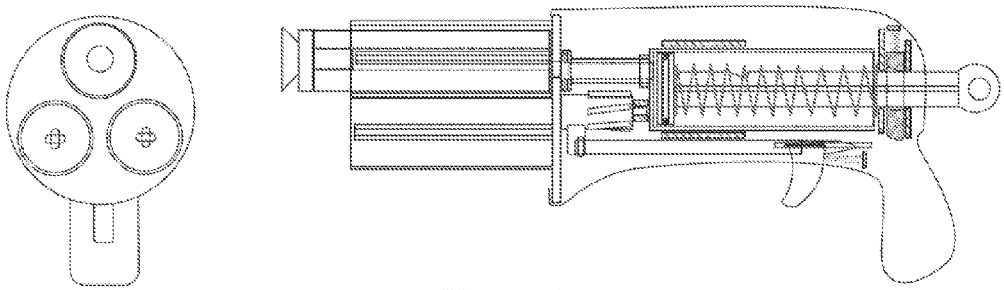
FIG. 2 is a schematic diagram of another prior toy gun having a pump chamber and a barrel with a plurality of projectile chambers, the barrel being automatically rotated to align one of the projectile chambers with the pump chamber when the trigger is actuated.
Figure 3:
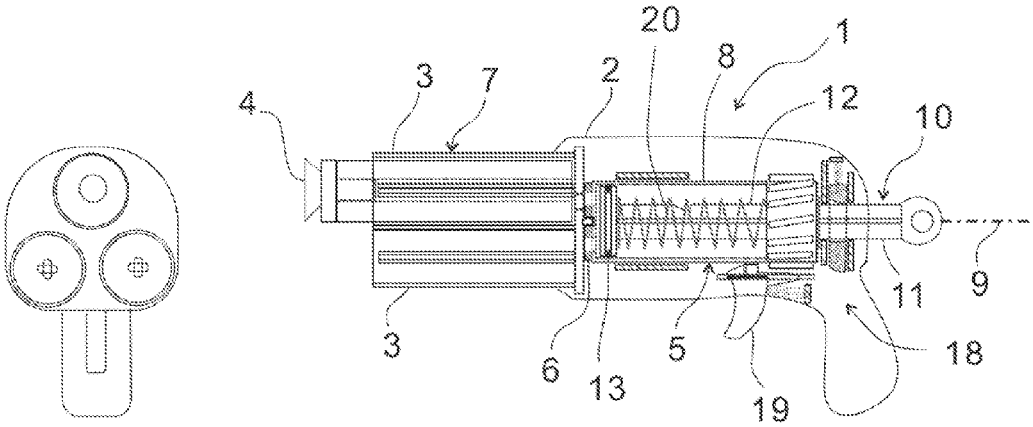
FIG. 3 is a schematic diagram of a toy gun in accordance with an embodiment of the present invention.

Referring to the figures, there is provided a toy gun 1 comprising a housing 2, and a plurality of projectile chambers 3. Each projectile chamber 3 is adapted to house a projectile 4, and each projectile chamber 3 is in fixed relationship with the housing 2. A pumping apparatus 5 has a delivery interface 6 alignable with each projectile chamber 3 in a sequence, such that when the delivery interface 6 is aligned with one of the projectile chambers 3, the pumping apparatus 5 is operable to drive air into said one of the projectile chambers 3 via the delivery interface 6.

In some embodiments, the projectile chambers 3 collectively form a barrel 7, whilst in other embodiments, the projectile chambers remain separate. The projectile chambers 3 or the barrel 7 can be separate units fixedly assembled to the housing 2. Alternatively, the projectile chambers 3 or the barrel 7 can be formed integrally with the housing 2. In this case, the projectile chambers 3 or the barrel 7 can be molded, for example, from plastics material, with the housing as one unit.

The pumping apparatus 5 comprises a pump tube 8 having a pump axis 9 and a pump ram 10 mounted to slide along the pump axis to drive air along the pump axis into said one of the projectile chambers 3 via the delivery interface 6. The pump tube 8 is also referred to as the pump chamber in the present specification. In some embodiments, the pump ram 10 is in the form of a reciprocating piston 11 with a rod 12 having a proximal end and a distal end, and a plate 13 connected to the distal end of the rod 12. The perimeter of the plate 13 conforms closely with the inside wall of the pump tube 8 so that when the piston reciprocates along the pump axis, air is pushed by the plate 13 with minimal air passing between the perimeter of the plate 13 and the inside wall of the pump tube 8.

In some embodiments, the delivery interface 6 is a hole 14 in an endplate 15 at an end of the pump tube 8. The hole 14 is alignable with each projectile chamber 3 in a sequence upon rotation of the endplate. In particular, each projectile chamber 3 has an inlet orifice 16 with which the hole 14 aligns to allow air driven by the piston 11 to pass through into the projectile chamber 3. In other embodiments, one or both of the hole 14 and the inlet orifice 16 has a conduit extending therebetween.

In one embodiment, only the endplate 15 itself rotates. In other embodiments, however, the endplate 15 is an integral portion of the pump tube 8, and the whole pump tube 8 rotates.

As a more specific example, in one embodiment, there are three projectile chambers 3 each with an inlet orifice 16. The inlet orifices 16 are arranged around a circle and spaced apart 120° from each other. The hole 14 rotates in 120° increments so that the hole 14 aligns with each inlet orifice 16 sequentially.

In other embodiments, as best shown in FIGS. 4*a* to 5*e*, the delivery interface 6 is a plurality of holes 14 in the endplate 15 at an end of the pump tube 8. One of the holes 14 is alignable with one of the projectile chambers 3 upon rotation of the endplate. Each projectile chamber 3 is aligned with one of the holes 14 in a sequence.

Referring specifically to the embodiment depicted in FIGS. 4*a* to 4*d*, three projectile chambers 3 are provided and mounted on a base flange 17. Each projectile chamber 3 has an inlet orifice 16. The inlet orifices 16 are arranged in a circle 120° apart from each other on the base flange 17. As depicted in FIG. 4*b*, the three inlet orifices 16 are in the following positions: top, bottom left, and bottom right.

The delivery interface 6 is four holes 14 in the endplate 15 of the pump tube 8. The four holes 14 are arranged in a circle 90° apart from each other. As depicted in FIG. 4*b*, the four holes 14 are in the following positions: top, left, right, and bottom.

FIG. 4*b* shows the top hole 14 aligned with the top inlet orifice 16. In this orientation, the left hole 14 is 30° away from the bottom left inlet orifice 16 in a clockwise direction. The right hole 14 is 30° away from the bottom right inlet orifice 16 in an anti-clockwise direction. The bottom hole 14 is in the centre between the bottom left and bottom right inlet orifices 16, with the bottom hole 14 60° away from each of the bottom left and bottom right inlet orifices 16. Therefore, only one of holes 14, namely, the top hole is aligned with one of the inlet orifices 16. The other holes 14 are out of alignment with the other inlet orifices 16 and are blocked off by the base flange 17.

FIG. 4*c* shows the pump tube 8, and therefore the endplate 15 and the holes 14, rotated 30° anti-clockwise from the orientation shown in FIG. 4*b*, with the left hole 14 now aligned with the bottom left inlet orifice 16. The other holes 14 are now out of alignment with the other inlet orifices 16 and are blocked off by the base flange 17.

Likewise, FIG. 4*d* shows the pump tube 8, and therefore the endplate 15 and the holes 14, rotated 60° anti-clockwise from the orientation shown in FIG. 4*b*, with the bottom hole 14 now aligned with the bottom right inlet orifice 16. The other holes 14 are now out of alignment with the other inlet orifices 16 and are blocked off by the base flange 17.

Figure 6A:
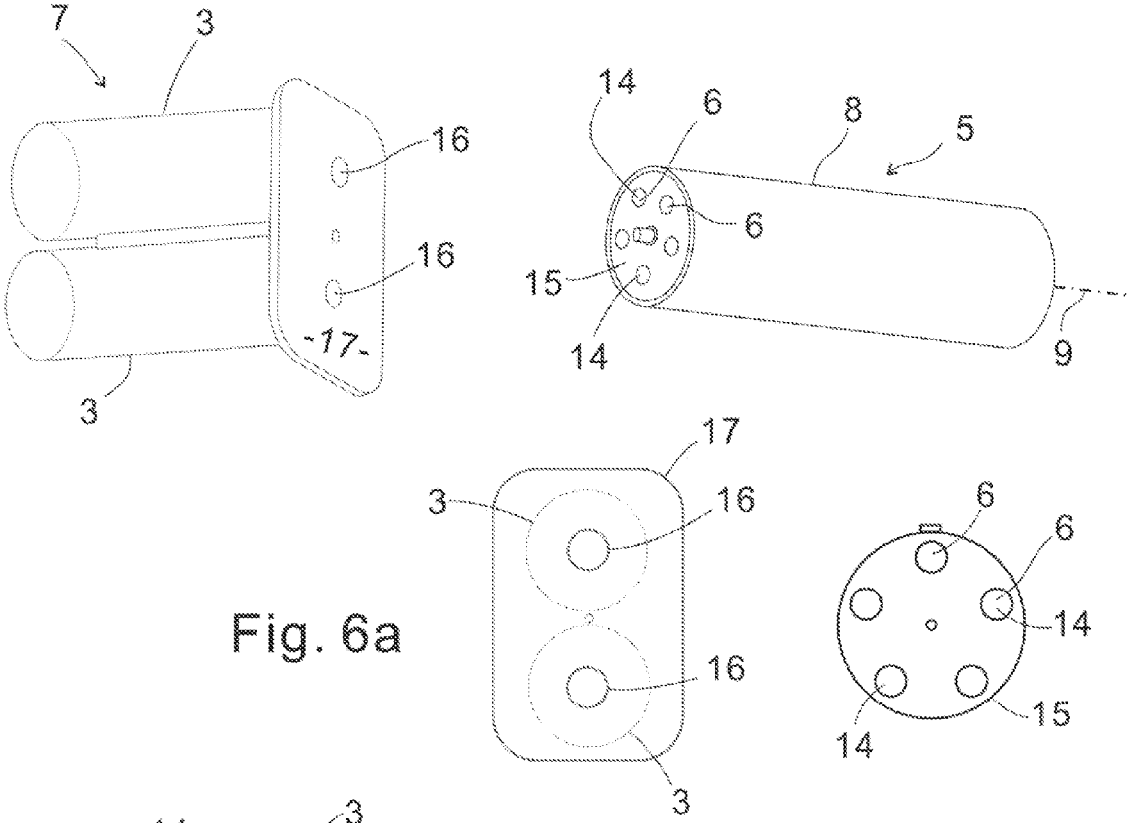
FIG. 6*a* is a schematic diagram of a barrel and a pump chamber of a toy gun in accordance with a further embodiment of the present invention, the barrel having two projectile chambers.
Figure 6B:
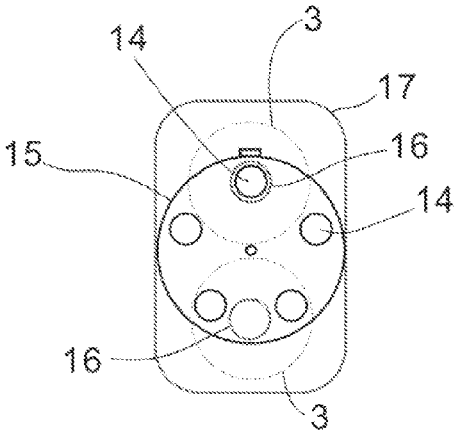
FIG. 6*b* is a front view of the toy gun of FIG. 5*a* showing the pump chamber at 0°.
Figure 6C:
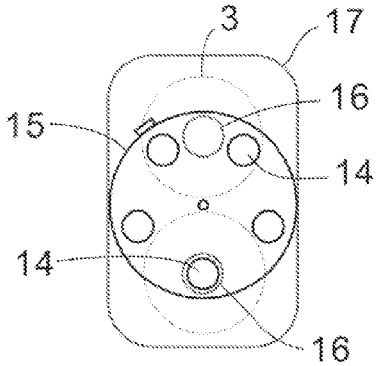
FIG. 6*c* is a front view of the toy gun of FIG. 5*a* showing the pump chamber advanced by 36°.

The embodiment shown in FIGS. 5*a* to 5*e* and the embodiment shown in FIGS. 6*a* to 6*c* both operate in a similar manner to the embodiment in FIGS. 4*a* to 4*d* and described in detail above. The embodiment shown in FIGS. 5*a* to 5*e* has four inlet orifices 16 and three holes 14. The embodiment shown in FIGS. 6*a* to 6*c* has two inlet orifices 16 and five holes 14. However, other combinations of numbers of holes and inlet orifices can work. For example, two inlet orifices and three holes can work, and three inlet orifices and two holes can also work.

As can be appreciated, by having a number of holes 14 that is different to the number of inlet orifices 16, rotation of the holes 14 by a certain angle will allow one of the holes 14 to align with one inlet orifice 16 whilst the other holes 14 are out of alignment with the inlet orifices. In the present embodiment, the out-of-alignment holes 14 are also blocked off by flange 17. With the holes 14 equally spaced in a circular arrangement as well as the inlet orifices 16 equally spaced in a circular arrangement, another rotation of the holes 14 again by said certain angle will allow another one of the holes 14 to align with the next inlet orifice 16 whilst the other holes 14 are out of alignment with the inlet orifices. The pumping apparatus 5 can thereby deliver air to each projectile chamber 3 sequentially by step-wise rotation of the holes 14 by said certain angle.

It can also be appreciated that varying the angular displacement of the holes 14 so that they are not equally spaced from each other, and/or varying the angular displacement of the inlet orifices 16 so that they are not equally spaced from each other, can also result in one hole 14 and one inlet orifice 16 being aligned with each other whilst the other holes 14 are out of alignment with the inlet orifices. Upon rotation of the holes 14 by a certain angle or angles, the next inlet orifice 16 is aligned with one of the holes 14 whilst the other holes 14 are out of alignment with the inlet orifices. In these cases, the number of holes 14 compared with the number of inlet orifices 16 can be the same or different.

Further, it can also be appreciated that an increased number of holes 14 reduces the amount of rotation required to rotate the pump tube 8 to align the delivery interface 6 with the next projectile chamber 3. This reduces the complexity of the mechanisms and components required. This is especially advantageous for smaller sized toy guns. As demonstrated in the embodiment shown in FIGS. 6*a* to 6*c*, the toy gun 1 has two projectile chambers 3 each with an inlet orifice 16. The inlet orifices 16 are arranged in a circle 180° from each other. The endplate 15 has five holes 14 equally spaced 72° from each other around a circle. Each rotation of the endplate 36° aligns one of the holes 14 with the inlet orifices 16 sequentially. If there were fewer holes 14, the amount of rotation required to align one of the holes 14 with the inlet orifices 16 sequentially would be greater. For example, if there were only three holes equally spaced 120° from each other, the amount of rotation would be 60°. If there was only one hole 14, the amount of rotation would be 180°. It has been found that having a combination of numbers of holes and inlet orifices that result in a rotation of 36° or less to align one of the holes with the inlet orifices sequentially is particularly advantageous in reducing the complexity of the mechanisms and components required. Examples of such mechanisms and components are described below.

The toy gun 1 further comprises a locking mechanism 18 and a trigger 19. The locking mechanism 18 is operable to lock the pump ram 10 in a cocked position against a resilient bias, which can be provided by for example a coil spring 20. The trigger 19 is operable to unlock the locking mechanism 18 to release the pump ram from the cocked position, thereby allowing the resilient bias to slide the pump ram 10 along the pump axis 9 to drive air along the pump axis into said one of the projectile chambers (that is, the projectile chamber whose inlet orifice 16 is aligned with a hole 14) via the delivery interface 6.

In some embodiments, the locking mechanism 18 rotates the endplate 15 as the locking mechanism is operated. In other embodiments, the trigger 19 rotates the endplate as the trigger is operated.

In the embodiments described above, air is pushed by the plate 13 towards the holes 14. The plate moves towards the holes 14 via the resilient expansion of the coil spring 20. One end of the spring 20 is engaged with the plate 13 whilst the other end of the spring 20 is engaged with the housing or a bracket fixed to the housing. When the plate 13 is pulled away from the holes 14, by for example pulling the rod 12 away from the holes 14, the spring 20 is compressed and a resilient bias builds up urging the plate 13 towards the holes 14. The locking mechanism 18 holds the plate 13 or the rod 12 at a position away from the holes 14 against the resilient bias of the coil spring 20. The pumping apparatus 5, and accordingly the toy gun 1, is thereby loaded or cocked.

The trigger 19 operates to unlock the locking mechanism 18 which allows the resilient bias built up in the spring 20 to release and push the plate 13 towards the holes 14 thereby driving air towards and through the hole 14 that is aligned with one of the inlet orifices 16 of one of the projectile chambers 3. The air driven in this way launches the projectile 4 housed in said one of the projectile chambers 3. This launching process can be repeated by pulling the rod 12 away from the holes 14 again to cock the pumping apparatus 5 and operating the trigger 19. The pump ram 10 therefore slides reciprocally along the pump axis 9.

The locking mechanism 18 can take the form of any of the known locking mechanisms in the field. For example, the locking mechanism 18 can include a catch that projects into a corresponding notch in the rod 12 thereby holding the rod in a retracted position away from the holes 14. The trigger 19 is attached to the catch so that when the trigger is pulled, the catch is pulled out of the notch to release the rod 12.

The locking mechanism 18 is also configured to rotate the endplate 15. In embodiments where the endplate 15 is an integral portion of the pump tube 8, the locking mechanism 18 is configured to rotate the whole pump tube 8. The rotation of the pump tube 8 can occur as the pumping apparatus 5 is cocked, or as the trigger 19 is pulled. In the latter case, the rotation can occur before or after the trigger 19 unlocks the locking mechanism 18. For example, as the trigger 19 is pulled (after the pumping apparatus 5 has been cocked), the trigger 19 operates a gear mechanism to rotate the pump tube 8 a certain angle so that the next inlet orifice 16 is aligned with the hole 14 or one of the holes 14. In the present embodiment, the rotation occurs before the trigger 19 unlocks the locking mechanism 18, but in other embodiments, the rotation can occur after the locking mechanism 18 is unlocked and air is driven through the hole 14.

It can be appreciated that the aforesaid embodiments are only exemplary embodiments adopted to describe the principles of the present invention, and the present invention is not merely limited thereto. Various variants and modifications may be made by those of ordinary skill in the art without departing from the spirit and essence of the present invention, and these variants and modifications are also covered within the scope of the present invention. Accordingly, although the invention has been described with reference to specific examples, it can be appreciated by those skilled in the art that the invention can be embodied in many other forms. It can also be appreciated by those skilled in the art that the features of the various examples described can be combined in other combinations.

The invention claimed is:

1. A toy gun comprising:

a housing;

a plurality of projectile chambers each adapted to house a projectile, each projectile chamber being in fixed relationship with the housing; and a pumping apparatus having a delivery interface alignable with each projectile chamber in a sequence, such that when the delivery interface is aligned with one of the projectile chambers, the pumping apparatus is operable to drive air into said one of the projectile chambers via the delivery interface, wherein the pumping apparatus comprises a pump tube from which air is driven into said one of the projectile chambers via the delivery interface, wherein the delivery interface is a plurality of holes in an endplate at an end of the pump tube, each of the holes being alignable with one of the projectile chambers, and wherein upon rotation of the endplate, each projectile chamber is aligned with one of the holes in a sequence.

2. A toy gun according to claim 1 wherein the pump tube has a pump axis and a pump ram mounted to slide along the pump axis to drive air along the pump axis into said one of the projectile chambers via the delivery interface.

3. A toy gun according to claim 2 comprising a locking mechanism and a trigger, the locking mechanism operable to lock the pump ram in a cocked position against a resilient bias, the trigger operable to unlock the locking mechanism to release the pump ram from the cocked position, thereby allowing the resilient bias to slide the pump ram along the pump axis to drive air along the pump axis into said one of the projectile chambers via the delivery interface.

4. A toy gun according to claim 3 wherein the locking mechanism rotates the endplate as the locking mechanism is operated.

5. A toy gun according to claim 3 wherein the trigger rotates the endplate as the trigger is operated.

6. A toy gun according to claim 5 wherein the trigger rotates the endplate before the trigger unlocks the locking mechanism.

7. A toy gun according to claim 5 wherein the trigger rotates the endplate after the trigger unlocks the locking mechanism.

8. A toy gun according to claim 1 wherein the number of holes is different to the number of projectile chambers.

* * * * *